United States Patent [19]

Mooney

[11] 4,402,239

[45] Sep. 6, 1983

[54] BACK-UP POWER TONGS AND METHOD

[75] Inventor: Tommy R. Mooney, Houston, Tex.

[73] Assignee: Eckel Manufacturing Company, Inc., Odessa, Tex.

[21] Appl. No.: 243,653

[22] Filed: Mar. 13, 1981

Related U.S. Application Data

[63] Continuation of Ser. No. 34,741, Apr. 30, 1979, abandoned.

[51] Int. Cl.[3] ..... B25B 17/00

[52] U.S. Cl. ..... 81/57.16; 81/57.19; 81/57.21; 81/57.34

[58] Field of Search ..... 81/57.16, 57.18, 57.19, 81/57.34, 57.21; 294/88, 116, 83 R; 279/4, 119; 269/238

[56] References Cited

U.S. PATENT DOCUMENTS

| | | | |
|---|---|---|---|
| 2,667,356 | 1/1954 | Forward | 279/4 |
| 2,668,689 | 2/1954 | Cormany | 81/57.16 |
| 3,149,851 | 9/1964 | Adams | 279/4 |
| 3,861,252 | 1/1975 | Stoffels | 279/4 |

FOREIGN PATENT DOCUMENTS

| | | |
|---|---|---|
| 1948353 | 9/1969 | Fed. Rep. of Germany . |
| 2000760 | 1/1970 | Fed. Rep. of Germany . |

*Primary Examiner*—James L. Jones, Jr.
*Attorney, Agent, or Firm*—Carwell & Helmreich

[57] ABSTRACT

Improved back-up tongs are provided for use with powered rotary tongs for making and breaking sections of drill pipe in a drill string. The tongs include a pair of jaw members which are slidably and radially driven into engagement with the drill pipe by levers having one end urgeable against corresponding ones of the jaw members, and having their other end hingedly coupled to a hydraulically driven push rod. Improved means are included for coupling the back-up tongs into close releasable association with the rotary tongs, and are further included for providing a more accurate measurement of the torque being applied to the pipe member during make-up of the drill string.

14 Claims, 7 Drawing Figures

FIG. 4
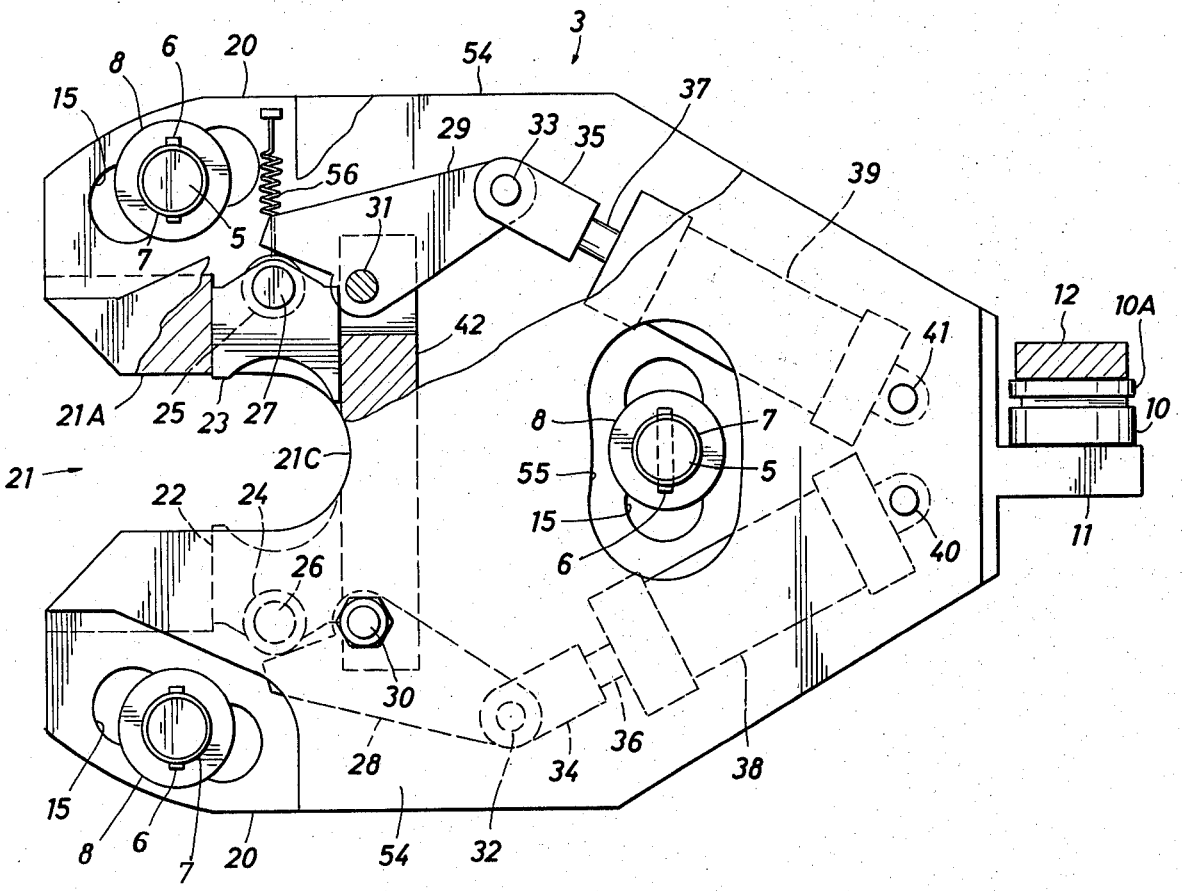
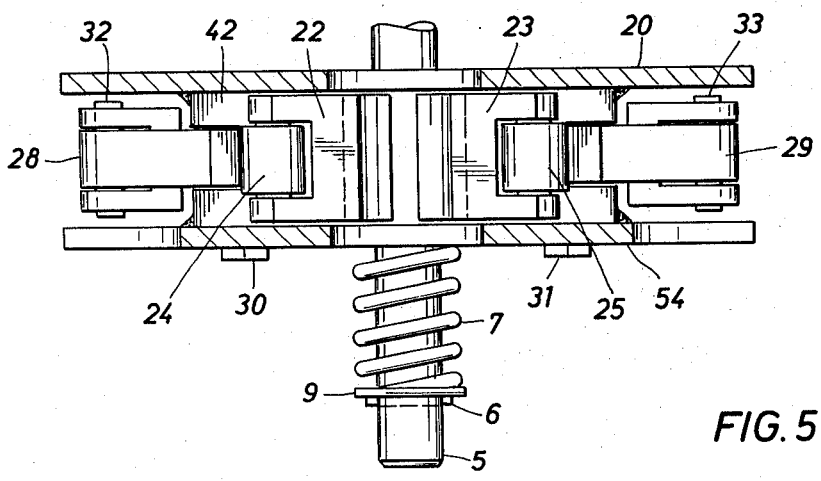
FIG. 5

FIG. 6
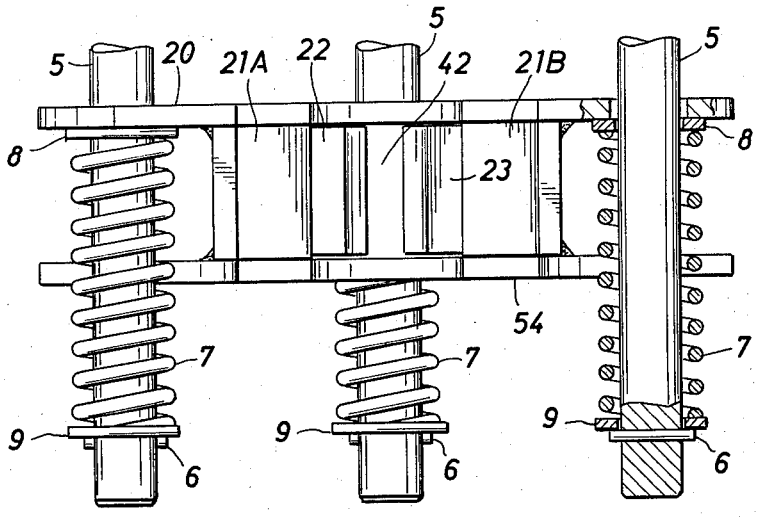
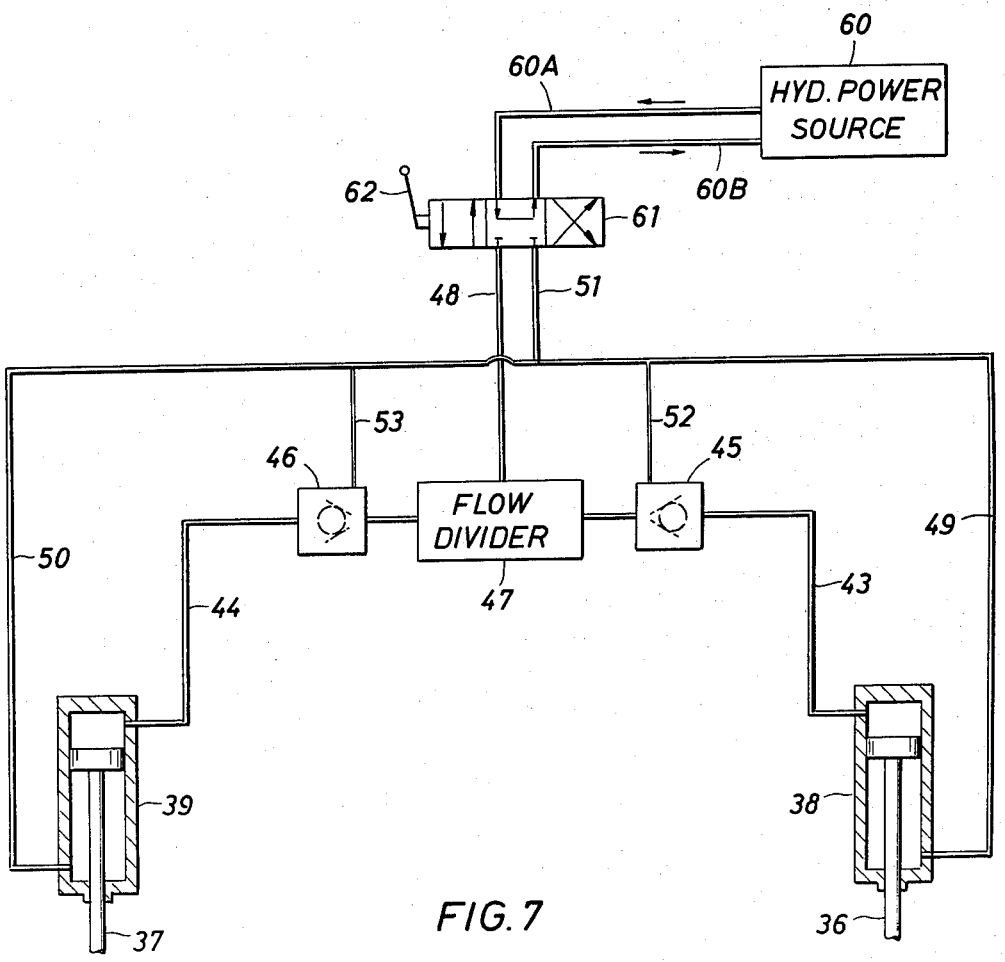
FIG. 7

BACK-UP POWER TONGS AND METHOD

This is a continuation of Ser. No. 34,741, which was filed on Apr. 30, 1979 and now abandoned.

BACKGROUND

This invention relates to means and methods for securing a pipe member and the like against axial rotation, and more particularly relates to improved back-up means and methods for connecting and disconnecting drill pipe of the sort commonly employed to drill oil and gas wells.

It is well known that oil and gas is found in subsurface earth formations, and that boreholes are drilled into these formations to recover these substances. What is not so well known, however, are the problems and difficulties which attend the drilling of such boreholes, and consequently the peculiarities and requirements which must be met.

In the first place, such wells are often thousands of feet deep in the earth, and therefore the mere drilling of such wells is a technological challenge, not only with respect to cutting away rock and soil of various character at different depths, but also the need to remove the drill cuttings being produced at the bottom of the borehole. Accordingly, it is now conventional to drill such wells using a bit or cutting tool which is suspended at the end of a tubular string of lengths of pipe. More particularly, the drill bit is rotated at the bottom of the borehold by rotation of the string of drill pipe at its upper end, while suitable drilling fluids or "muds" are pumped down the interior of the drill string and out through apertures in the drill bit.

The drilling mud or slurry serves various essential purposes, in addition to lubrication of the cutting surfaces of the drill bit. The mud which flows down the interior of the drill string, returns to the surface by way of the annular space between the wall of the borehole and the outside surface of the drill string, to carry away the drill cuttings which would otherwise accumulate in the borehole. Thus, the drilling mud also serves as a lubricant between the wall of the borehole and the string of revolving drill pipe. Furthermore, the weight of the column of drilling mud in the borehole provides a back-pressure in the event that the drill bit unexpectedly encounters a formation containing fluids under an abnormally high pressure.

The string of drill pipe is necessarily assembled at the surface on a piece-by-piece basis, wherein each length or "joint" of drill pipe is selectively connected to the upper end of the last joint previously added, as the string is progressively lowered into the borehole. Similarly, each time it becomes necessary to repair or replace the drill bit, (which occurs many times during the drilling of deeper boreholes), the string of pipe is progressively lifted out of the borehole as the topmost joint of pipe is removed.

Although there are many difficulties attending the drilling of a borehole in the earth, there are particular difficulties which relate to the making and breaking of the threaded couplings between the joints of drill pipe. Since drill pipe tends to lose wall thickness as it is revolved in the borehole, it is undesirable to apply any significant gripping force to a joint of drill pipe lest this effect a crushing which, in turn, tends to produce a longitudinal weakening in the pipe. On the other hand, it is essential that sufficient torque be applied to the pipe to achieve a fluid-tight connection between each two joints of pipe, to avoid a pressurized discharge of drilling fluid which erodes the wall of the borehole, and this in turn necessitates the application of a heavy gripping force. In an attempt to compromise these two conflicting needs, most drill pipe is now formed with a box-like portion at one end, the "box" being provided with extra-heavy wall thickness and with inside threads, and with an extra-heavy wall thickness immediately adjacent the exterior threads at the other end. Provision of a wall thickness of this magnitude will, even for drill pipe having a severely eroded exterior, permit the pipe to resist compressional forces which might otherwise crush the pipe but which are necessary to apply adequate torque to the pipe in making and breaking the threaded connections between two joints of drill pipe. Nevertheless, this has further necessitated that the pipe be seized only at the two end portions having an extra-heavy wall thickness, and under no circumstances at any other place along each joint of drill pipe.

Originally, the drill string was assembled and disassembled using two sets of manually operated pipe tongs, wherein one set was applied to the "box" portion of the pipe at the upper end of the drill string in the borehole, and the other set was applied to the lower end (immediately above the threads) of the pipe being added or removed from the drill string.

The upper set of tongs was conventionally interconnected by a cable and torque gauge to a powered winch, and the lower set of tongs was connected oppositely thereof through a cable to a point of anchorage on the drilling rig. When the winch was activated, the connecting cable would turn the so-called "pipe tongs" to rotate the upper joint until the torque gauge registered the torque considered to effect a fluid-tight seal, (during make-up of the drill string), or to break the threaded connection in the case of disassembly of the drill string. The snubbing cable attached to the lower tongs would, of course, secure the lower tongs and thus the box portion of the lower joint of drill pipe from rotation during this process.

It will readily be apparent that such a process was time consuming and therefore expensive. More particularly, however, it was often extremely dangerous because of the possibility of cable breakage, and this possibility was increased when the so-called "manual" tongs used to rotate the upper pipe joint were replaced by hydraulically-actuated rotating tongs of the type depicted in U.S. Pat. No. 4,084,453, in order to achieve even higher torques prescribed for threaded connections in deeper boreholes.

Another disadvantage to such techniques, even after hydraulically-actuated rotary tongs came into widespread use, arose out of the inaccuracy of the measurement being provided by the torque gauge now interconnected with the snubbing cable. More particularly, it was long recognized that the torque gauge would accurately indicate the torque on the pipe only when the two cables were positioned to define force vectors which, in turn, were positioned at exactly 90 degrees of each other, and that this condition would only exist momentarily as the upper pipe was revolved. Thus, the problem of achieving a fluid-tight seal between adjacent lengths of drill pipe continued to exist even after the adoption of powered rotary tongs.

In some instances it has been found useful to couple the so-called "manual" back-up tong to the powered rotary tong assembly, whereby the two sets of tongs might be handled and operated as a unit, and whereby the drill string could be more quickly and conveniently connected and disconnected. In such an arrangement, of course, the two tongs tend to be snubbed together whereby at least one of the two cables were eliminated. Even this has become impractical with the need to develop increasingly higher torques by the rotary tong assembly, however, which were beyond the gripping capability of conventionally designed "manually-operated" tongs. Accordingly, there has long existed a need for powered back-up tongs which can develop a gripping force on the box portion of the drill pipe which is capable of immobilizing the drill string against the torques now required to obtain a fluid-tight pipe connection.

There have, of course, been many attempts to develop powered back-up tong assemblies having this capability, although all such attempts have been less than completely successful. One significant problem, which has prevented the use of designs similar to those incorporated in the rotary powered tong assemblies, has been the need to locate the back-up tongs at the box of the lower drill pipe and therefore immediately below and in close proximity to the lower surface of the rotary powered tongs. Another problem arises from the fact that, although a combination of the rotary and back-up tongs may eliminate the snubbing cables, the combined tong assembly is itself a hazard in the event of unscheduled vertical movement of any portion of the drill string.

These and other disadvantages of the prior art are overcome with the present invention, and improved powered back-up tongs are herewith provided for interconnection and use with powered rotary tongs.

SUMMARY OF INVENTION

In a preferred embodiment of the present invention, a powered back-up tong assembly is provided having a pair of oppositely movable jaw members which are arranged to be radially driven into gripping engagement with the box portion of a joint of drill pipe. More particularly, the two jaw members are supported by a pair of upper and lower plate members shaped substantially in conformance with the general configuration of the rotary tong assembly, and having an open throat portion for receiving and fitting the two jaw members about the pipe member sought to be secured against rotation.

Each jaw member is interconnected with its own separate driving assembly which, in a particularly suitable form, includes a hydraulic cylinder pivotally anchored at its rearward end between the two plate members, and having its piston rod hingedly connected to one end of a pivotally anchored lever having its other arm urged against the jaw member. Since both cylinders are sought to be cooperatively actuated, whereby both jaw members are driven in synchronism, hydraulic power is supplied to the cylinders through a flow divider so that both piston rods are extended in unison and through the same distance. Thus, both jaw members are extended exactly the same distance so as to avoid warping or misalignment of the drill pipe at the same time the rotary tong assembly (which is linked to the back-up tongs) is applying torque to the pipe assembly.

It will be apparent that, although the back-up and rotary tong assemblies are intended to be interlinked as a unit, the connection between the two must be flexible within prescribed limits. Furthermore, such flexibility must not only permit limited movement in the direction of application of the torque to the pipe member, but also limited movement between the two tong assemblies along the longitudinal axis of the drill string.

Referring more particularly to the matter of linkage of the two tong assemblies, the rotary tong assembly is preferably provided with three downwardly extending rod members which, in turn, are each preferably provided with a plurality of pin apertures at various locations along their length. The back-up tong assembly, in turn, is conveniently provided with corresponding apertures through which these rods will extend when the back-up tong assembly is positioned immediately below the rotary tong assembly. A shear pin is inserted through the aperture in each rod, which thereby selects the maximum vertical spacing sought to be maintained, and the back-up tong assembly then rests on these three shear pins. In addition, a spring or other resilient means is preferably disposed between the shear pin and the under surface of the top plate of the back-up assembly, to absorb impact when the back-up tong assembly is drawn against the rotary tong assembly as the two sections of drill pipe are screwed together. Similarly, the springs tend to soften the reaction when the two tong units separate, as by removal of a section of drill pipe from the drill string.

With respect to lateral movement between the two units, the holes to be provided in the back-up tong assembly are preferably formed in the manner of arcuate slots having a radius of curvature and position corresponding to rotation about the pipe string. More particularly, each unit is also provided with a rearwardly extending bracket member which tend to be urged toward each other when the rotary tong assembly applies torque to the pipe member, and thus a suitable torque sensor may be arranged to be compressed between these two brackets to provide an extremely accurate measurement of the torque applied to the pipe member unless the rods move against the ends of the slots.

It sometimes happens that the operator of the winch (not depicted), which supports the upper joint of drill pipe 4, will activate and lift that joint of drill pipe after it has been unscrewed from the box gripped by the back-up tongs, but before it has been released by the rotary tong assembly. Similarly, it will sometimes happen that the slips in the rotary table will fail to hold the drill string, and if the tong assemblies are gripped to the drill string, or even if only the back-up tongs are then gripped to the drill string, this may cause both tong units to be carried away from their suspension means. In both cases, this creates an extreme risk to personnel in the vicinity, by virtue of the collapse of several thousand pounds of equipment onto the drilling platform, and is another reason why powered back-up tongs have not previously been considered desirable.

In the present invention, this disadvantage is substantially overcome by the fact that, in either of these cases, the shear pins will sever to separate the back-up tong assembly from the rotary tong assembly. If the operator has inadvertently prematurely activated his winch, as in the first example, this will merely lift the rotary tong assembly free of the back-up tongs without other misadventure. If the drill string begins to collapse into the borehole, as in the other example, this may carry the back-up tong assembly to the floor of the drilling ring, but the rotary tong assembly will be freed to remain in its normal position.

Accordingly, it is an object of the present invention to provide improved back-up tongs and method for securing a pipe member against rotation by powered rotary tongs and the like.

It is also an object of the present invention to provide improved hydraulic powered back-up tongs and method.

It is further an object of the present invention to provide improved hydraulically-actuated back-up tongs for securing drill pipe and the like against a high rotational torque.

It is further an object of the present invention to provide improved back-up tong means and method for cooperating with powered rotary tongs to develop a more accurate measurement of torque being applied to a pipe member and the like.

It is also an object of the present invention to provide improved back-up tong means releasably interconnectable with powered rotary tongs and the like.

It is a specific object of the present invention to provide improved apparatus for securing a pipe member against axial rotation, comprising first and second gripping members radially and oppositely movable toward said pipe member, first and second lever means pivotally and oppositely movable toward respective ones of said gripping members, and first and second hydraulic cylinder means having their piston members interconnected with respective ones of said first and second lever means.

These and other objects and features of the present invention will become apparent from the following detailed description, wherein reference is made to the figures in the accompanying drawings.

IN THE DRAWINGS

FIG. 4 is a similar bottom view of the same back-up tongs depicted in FIGS. 2 and 3.

FIG. 5 is a pictorial view, partly in cross section, of a selected portion of the apparatus depicted in FIG. 3.

FIG. 6 is another pictorial view, partly in cross section, of another different portion of the apparatus depicted in FIG. 3.

FIG. 7 is a functional diagram of the hydraulic circuits and components depicted in part in FIG. 2.

DETAILED DESCRIPTION

Figure 1:
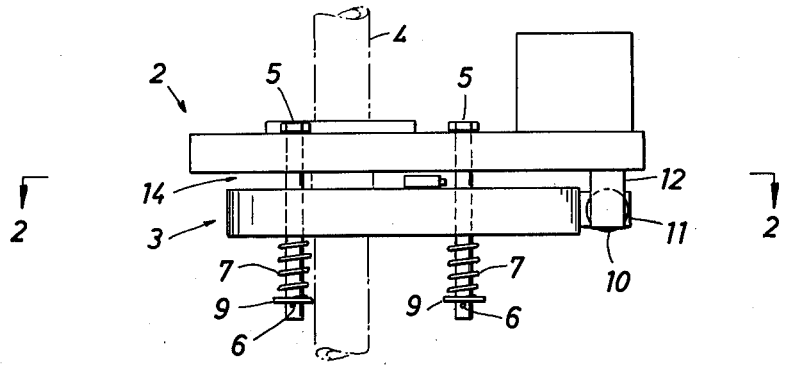
FIG. 1 is a simplified pictorial representation of powered rotary and back-up tongs embodying one form of the present invention.
Figure 2:
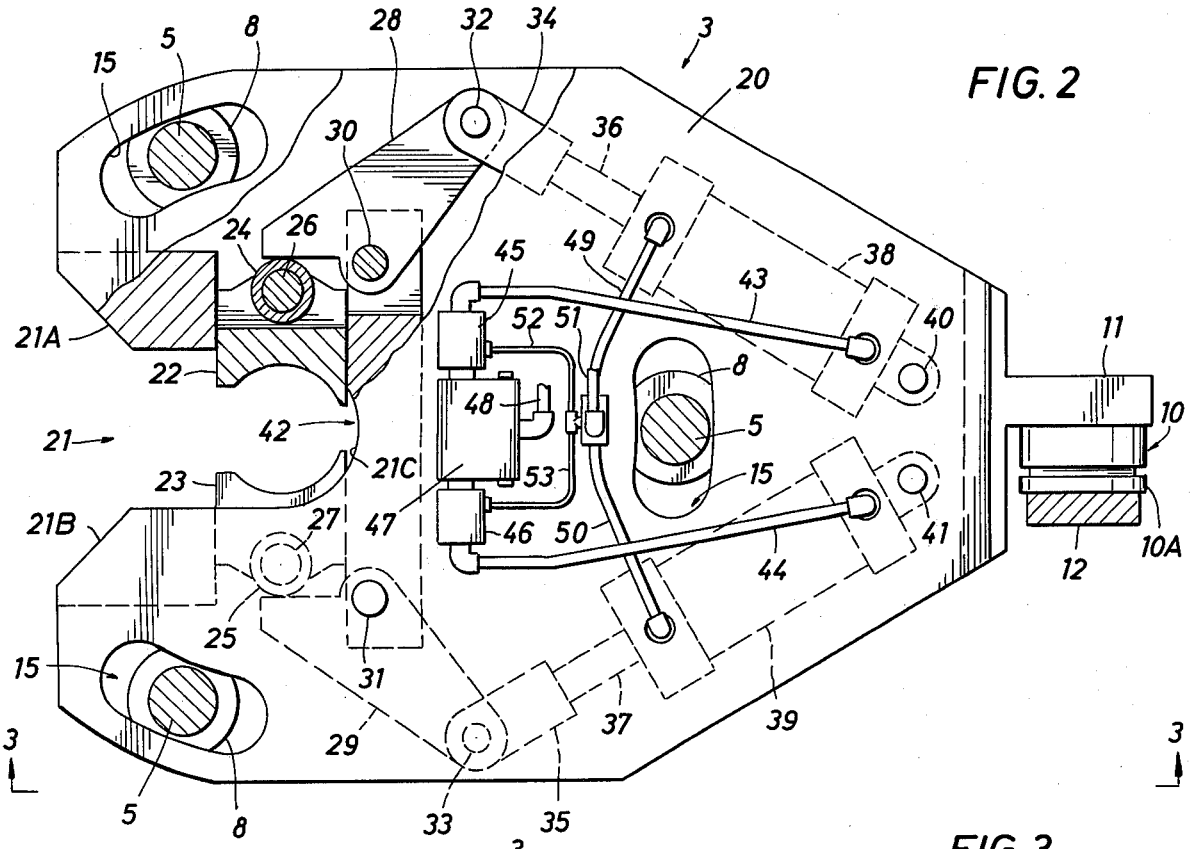
FIG. 2 is a simplified pictorial top view, partly in cross section, of the back-up tongs depicted generally in FIG. 1.
Figure 3:
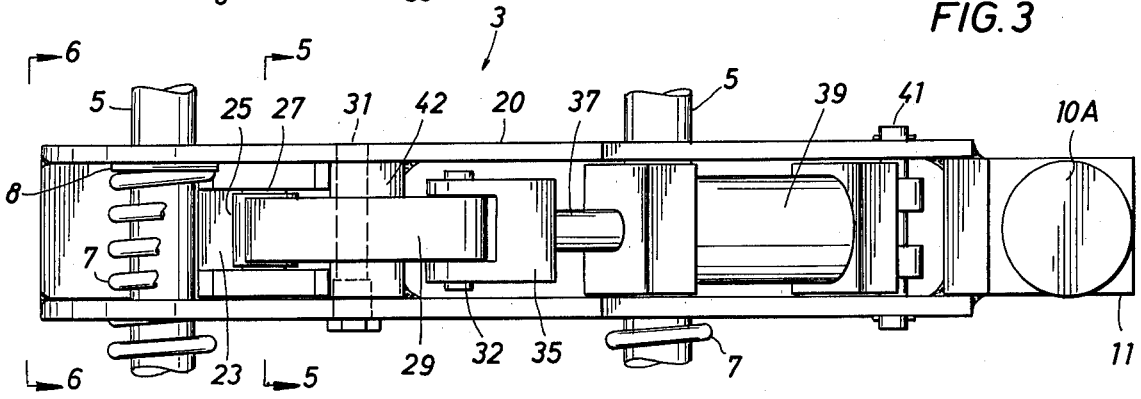
FIG. 3 is a similar side view of the same back-up tongs depicted in FIG. 2.

Referring now to FIG. 1, there may be seen a simplified pictorial side view of apparatus embodying at least one concept of the present invention, and including a suitable rotating power tong assembly 2 disposed about an appropriate location along the length of a joint of drill pipe 4. In addition, and located immediately below, there is provided a back-up power tong assembly 3 of the type hereinafter described in detail. The rotating power tong assembly, which operates to apply rotational torque to the length of drill pipe 4, is preferably provided with a plurality of support rods 5 which, in turn, extend fixedly down in parallel with the drill pipe. The back-up power tong assembly 3, therefore, will preferably be provided with suitable apertures whereby it may be disposed about these support rods 5, to provide for a minimum gap 14 or spacing between the rotating power tongs 2 and the back-up power tong assembly 3.

At the lower end of each of the support rods 5, there is preferably provided a plurality of suitably spaced-apart apertures through which a shear pin 6 may be inserted. Between the shear pin 6, and the back-up power tong assembly 3, there is preferably provided a suitable washer 9 or other appropriate retaining means, and a suitable spring means 7, whereby the back-up power tong assembly 3 is supported in close proximity to the underneath surface of the rotating power tong assembly 2.

Referring again to FIG. 1, it may be seen that the back-up power tong assembly 3 is preferably provided with a rearwardly extended bracket 11 which supports an appropriate torque sensor 10. In addition, the rotating power tong assembly 2 is also provided with an appropriate bracket 12 which extends down to drive laterally and rotatably against the torque sensor 10 whenever the rotating power tong assembly 2 is actuated to apply rotational force or torque to the joint of drill pipe 4. Since the back-up power tong assembly 3 is designed to immobilize the length of drill pipe 4, each of these brackets 10 and 12 tend to be driven together, to not only cooperatively snub both the rotating power tong assembly 2 and the back-up power tong assembly 3, whereby they do not revolve dangerously about, but whereby they cause the torque sensor 10 to provide an appropriate indication of the amount of torque being applied therebetween, (and also consequently to the length of drill pipe 4).

It should be noted that the function of the shear pin 6 is not only to provide for coupling of the back-up power tong assembly 3 to the rotating power tong assembly 2, but also to act as a safety release in the event these two components inadvertently separate. More particularly, it sometimes happens that the drill string (in this case represented by the portion of the drill pipe 4 which is gripped by the back-up power tong assembly 3) tends to drift downwardly into the bore hole due to failure of the slips in the rotary table (not depicted). Although the rotating power tong assembly 2 is appropriately supported by suspension from above (by means not depicted in FIG. 1), such suspension cannot carry the weight of the drill string, and thus there is an immediate danger that two power tong assemblies 2 and 3 may be brought down with attendant risk of injury to personnel in the immediate vicinity. However, the shear pins 6 are intended to sever in such an eventuality, thereby relieving the rotating power tong assembly 2 from the weight of the drill string represented by the length of drill pipe 4, whereby only the back-up power tong assembly 3 will descend to the floor of the drilling platform (not depicted). If the back-up power tong assembly is then actuated to engage the length of drill pipe 4, the rate of descent of the back-up power tong assembly 3 will be not more rapid than the rate of descent of the drill pipe 4 into the bore hole.

Similarly, it sometimes happens that the operator of the winch (not depicted) which supports the upper end of the drill pipe 4, will actuate and raise the pipe after it has been unscrewed from the lower portion of the pipe 4 which is gripped by the back-up power tong assembly 3, but before the rotating power tong assembly 2 has been disconnected from the upper end of the pipe 4. In this event, both of the power tong assemblies 2 and 3 would be carried dangerously upwardly except that the shear pin 6 will sever to disengage the back-up power tong assembly 3 from the rotating power tong assembly 2. Since the winch (not depicted) is easily capable of supporting the rotating power tong assembly 2, as well as the single joint of drill pipe 4 being gripped thereby, this greatly minimizes the risk of injury to the adjacent personnel.

Referring now to FIGS. 2–6, there may be seen simplified pictorial views of the back-up power tong assembly 3 generally depicted in FIG. 1, and further showing that this assembly includes a suitable top plate 20 with elongated arcuate slots 15 for containing the three support rods 5. In addition, there is a washer 8 or other suitable retaining means interposed between the upper end of each spring 7 and the lower surface of the top plate 20, for the purpose of engaging the upper plate 20.

It will be noted that the elongate arcuate configuration of the slots 15 provide for sufficient movement of the rods 5, whereby the brackets 11 and 12 may be brought together to cause the plunger 10A, of the torque sensor 10, to provide an accurate indication of the torque developed between the power tong assemblies 2 and 3 when the rotating power tong assembly 2 is actuated to rotate the pipe member 4, but not such that slots 15 will limit such travel prior to reaching the torque desired, and to then provide a false reading of the torque actually applied to the pipe member 4.

Referring again to FIGS. 2–6, it may be seen that the back-up power tong assembly 3 is provided with an open throat portion 21 whereby the rotating tong assembly 2 may be inserted about the pipe member 4. More particularly, the throat portion 21 is a space formed by the upper and lower plates 20 and 54, and more particularly by the spacing between the guide blocks 21A-B which, in turn, cooperate with a bracing block 42 to provide slidable support and guidance for a pair of jaw members 22 and 23 adapted to be driven into gripping engagement with the pipe member by levers 28 and 29. More particularly, the left jaw member 22 may be seen to be provided with a pin 26 and rotatable bushing 24 which, in turn, is urgeably engaged by the lever 28 which, in turn, is pivotally interconnected with the left hand end of the bracing block 42 by means of pivot pin 30. Rotation of the lever 28 about pivot pin 30 is affected by the driving assembly composed of the hydraulic cylinder 38 having its piston rod 36 and clevis member 34 interconnected with the opposite end of the lever 28 by hinge pin 32. In addition, cylinder 38 is hingedly fixed between the upper and lower plate members 20 and 54 by hinge pin 40, whereby extension of the piston rod 36 will rotate the lever 28 in a counterclockwise direction to drive the left hand jaw member 22 against the pipe member 4.

Similarly, the right-hand jaw member 23 is provided at its opposite end with a rotatable bushing 25 which, in turn, is disposed about pin 27, whereby the right-hand jaw member 23 may be driven against the pipe member 4 by clockwise rotation of the right-hand lever 29 about pivot pin 31 which, in turn is interconnected with the opposite end of the bracing block 42. More particularly, rotation of lever 29 is affected by the driving assembly composed of the hydraulic cylinder 39 which is pivotally fixed between the upper and lower plate members 20 and 54 by pivot pin 41, and which has its piston rod 37 interconnected with the opposite end of the right-hand lever 29 by means of clevis member 35 and hinge pin 33.

Operation of the back-up power tong assembly 3 may be achieved by an actuating valve 61, which is functionally suggested in FIG. 7, to connect hydraulic power through fluid supply line 60A and 48, to an appropriate flow equalizer device 47, and thence equally through check valves 45 and 46 to extend lines 43 and 44 leading to the extend ports of the hydraulic cylinders 38 and 39. Extension of piston rods 36 and 37 will, of course, be accompanied by return flow of the hydraulic fluid through return lines 49 and 50, and thence by way of the fluid supply line 51 to the hydraulic fluid supply 60 which is suggested functionally in FIG. 7.

It should be noted that the jaw members 22 and 23 are not only driven slidably between the bracing block 42 and the left and right-hand guide blocks 21A-B to securely engage the pipe member 4, but that such engagement is maintained by the check valves 45-46 unless and until the actuating valve 61 is intentionally repositioned. More particularly, it is the function of the check valves 45 and 46 to trap hydraulic fluid within the extend lines 43 and 44 whereby the piston rods 36 and 37 are maintained in their extended position regardless of whether hydraulic pressure is present in lines 43 and 44. Alternatively, however, when it is intended to retract the piston rods 36 and 37 to release the jaw members 22 and 23 from the pipe member 4, it will be seen in FIG. 7 that the actuating valve 61 may be positioned so as to apply hydraulic power through intake line 51, and to reconnect line 48 to the return line 60B leading to the hydraulic power source 60 as indicated in FIG. 7. Accordingly, the arrival of hydraulic power through line 51 will not only connect hydraulic fluid through lines 49 and 50 to the return ports of cylinders 38 and 39, such power will also be applied through lines 52 and 53 to release the check valve 45 and 46, whereby hydraulic fluid may now return through lines 43 and 44 to line 48, and may thereafter flow through the actuating valve 61 to the return line 60B of the hydraulic power supply 60.

As hereinbefore stated, it is essential that maximum travel of the jaw members 22 and 23 be provided for, due to the fact that the pipe member 4 (and especially that type of pipe employed to compose a drill string), be securely engaged against rotation by the rotating power tong assembly 2. It will thus be noted that the travel limits of jaw members 22 and 23 will not only be determined by the configuration of the bracing block 42 and the left and right-hand guide blocks 21A-B, but also by the position of the pivot pins 30 and 31 between the opposite ends of the two levers 28 and 29. In other words, the greater the spacing between pins 30 and 32 in the lever 28, and also between pins 31 and 33 in lever 29, the lesser the travel of the two jaw members 22 and 23 upon extension of the piston rods 36 and 37. More particularly, however, the greater the spacings between pins 30 and 32, and between pins 31 and 33, the greater the driving force which may be applied to jaw members 22 and 23 by levers 28 and 29, to thereby reduce the size of the hydraulic cylinders 38 and 39 needed to affect back-up engagement of pipe member 4.

As hereinbefore stated, it is a primary function of the bracing block 42 to provide for slidable support for the jaw members 22 and 23. In addition, however, the bracing block 42 also interconnects the two forkedly extending portions of the top and bottom plate members 20 and 54 which define the throat portion 21 of the back-up power tong assembly 3, whereby these portions are prevented from spreading when the jaw members 22 and 23 are subjected to an opposing force from the rotating power tong assembly 2, and whereby the jaw members 22 and 23 may become disengaged from the pipe member 4. It should be noted, however, that maximum spacing between pins 30 and 32, and between pins 31 and 33, may require that the bracing block member 42 be provided with concave aperture 21C to accommodate the pipe member 4.

Referring now to FIG. 5, it will be noted that the bottom plate 54 does not extend about the two rods 5 on the opposite sides of the open throat portion 21, and that the arcuate aperture 55, which surrounds the rearward rod 5, is substantially larger than its corresponding aperture 15 in the upper plate. The reason for this is that it is the upper plate 20 which carries the entire weight of the back-up tong assembly 3, therefore there is no need to extend the lower plate 54 about any portion of the front pair of rods 5. Further, since the back-up tong assembly 3 is intended to be released entirely from the rods 5 upon severing of the shear pins 6, it is essential that the arcuate aperture 55 in the lower plate 54 be larger than the washer 8, whereby the back-up tong assembly 3 may drop free of all portions of the rotary tong assembly 2.

As hereinbefore stated, it is intended that the levers 28 and 29 function to drive the jaw members 22 and 23 into gripping engagement with the pipe member 4, upon extension of the piston rods 36 and 37. It will therefore be noted, in FIG. 4, that a suitable spring means is preferably included to retract the jaw members 22 and 23, upon retraction of the piston rods 36 and 37 into the cylinders 38 and 39. More particularly, the spring means is indicated by spring 56, which is shown in FIG. 4 as interconnected at one end to pin 27, and at its other end to an appropriate portion of either the upper or lower plates 20 and 54. Accordingly, when lever 29 is rotated to drive jaw member 23 into engagement with the pipe member 4, this will elongate the spring 56. When lever 29 is rotated away from bushing 25, however, spring member 56 will contract to withdraw jaw member 23 from engagement with the pipe member 4. A similar spring means is preferably interconnected with jaw member 22, but is not specifically indicated in FIG. 4.

Referring again to FIG. 2, it will be noted that, in this type of back-up tong assembly, no rotational force or torque is inherently developed merely by engagement of the pipe member 4 by the jaw members 22 and 23, inasmuch as the gripping force is generated, in the first instance, by extension of piston rods 36 and 37. In the case of the rotary tong assembly 2, however, this unit will develop a tendency to revolve oppositely the direction of torque which is applied to the pipe member 4, and in the case where a section of pipe is sought to be added to the drill string, this torque will tend to develop in a counterclockwise direction. Accordingly, in such an operation the rearward bracket 11 tends to snub the revolving rotary tong assembly 2, and further to support the sensor 10 against compression of the sensor piston 10A by the bracket 12 of the rotary tong assembly 2.

This will, of course, be reversed during break out length of drill pipe from the drill string, since the rotary tong assembly 2 will tend to revolve in an opposite direction when unscrewing drill pipe. Thus the two bracket members 11 and 12 will tend to separate, rather than to draw together, and thus no torque measurement will be provided by the sensor 10. This is inconsequential, however, since a torque measurement is only required to indicate when sufficient torque has been generated during interconnection of the length of drill pipe in the drill string, and since torque is only required in a magnitude sufficient to break apart a threaded joint when the drill string is being disconnected. It will also be noted that, during disassembly of the drill string, the two bracket members 11 and 12 will no longer snub each other together. However, this function will be performed by the rods 5 moving within the arcuate slots 15 in the top plate 20.

As hereinbefore stated, a back-up tong assembly of the type hereinbefore discussed is particularly suitable for use with drill pipe which, although relatively small in outside diameter, requires applications of very high torque both to interconnect and disconnect the threaded connections, by reason of the particular arrangement of levers and hydraulically actuated piston rods. However, a back-up tong assembly of this type is clearly not limited to use with only drill pipe, but is particularly useful with any type of threaded members sought to be connected or disconnected, and especially with respect to well tubing joints and lengths of sucker rod and the like. In addition, embodiments of the invention may be often useful for many larger sizes of tubing or pipe, such as threaded well casing, line pipe, and the like.

It will be readily apparent from the foregoing description that modifications and substitutions of components may be made without departure from concept of the present invention. Accordingly, it should be understood that the structures and techniques hereinbefore depicted and described are intended as examples only and are not intended as limitations on the scope of the invention.

What is claimed is:

1. An apparatus for preventing axial rotation of a pipe member by a rotary tong assembly having downward extending leg portions affixed to said rotary tong assembly, said apparatus comprising:

a body member having an open throat portion for receiving said pipe member and a plurality of apertures for receiving said downward extending leg portions of said rotary tong assembly, first and second gripping members within said body member each linearly and radially movable toward said pipe member, first and second powered cylinder means each pivotably mounted within said body member and interconnected with one of said gripping members for urging said gripping members into engagement with said pipe member, power supply means connected to both said first and second cylinder means for simultaneous activation of said gripping member, first and second pivotally mounted lever means each pivotably connected with a respective one of said cylinder means and in engagement with a respective one of said gripping members for increasing the force exerted on said pipe member by said gripping members in response to said cylinder means, and a bracing block member affixed within said body member in a position opposite said open throat with respect to said gripping members for providing pivotable support for said lever means and preventing said open throat portion of said body member from spreading.

2. The apparatus of claim 1, wherein said power supply means comprises:

a source of hydraulic fluid under pressure, pressure line means connecting said source to said first and second powered cylinders, flow divider means within said pressure line means for equalizing said hydraulic fluid between said first and second powered cylinders, return line means connecting said first and second powered cylinders to said source, and a pair of check valve means each interconnected between said flow divider means and a respective one of said hydraulic cylinder means.

3. The apparatus of claim 1, further comprising a pair of spaced-apart guide members each slidably engaging a respective one of said first and second gripping members and defining said open throat portion for receiving said pipe member.

4. The apparatus of claim 3, further comprising resilient means interconnected at one end to said body member and at the other end to one of said first and second gripping members for yielding opposing movement of said gripping member toward said pipe member.

5. The apparatus of claim 1, further comprising first and second bushing members carried by and rotatable with respect to said first and second gripping members, respectively, for engagement with a respective one of said lever means.

6. In a rotary tong assembly for rotating a first pipe member for threaded engagement with a second pipe member and back-up tong apparatus for preventing axial rotation of a second pipe member, said back-up tong apparatus including gripping members arranged for engagement with said second pipe member and power means for urging said gripping members toward said second pipe member, the improvement comprising:

a plurality of downward extending leg members affixed to said rotary tong assembly, an upper plate member of said back-up tong apparatus having an open throat portion, for receiving said second pipe member and further having a plurality of apertures for receiving said downward extending leg members, and a plurality of shear means each affixed to a respective leg portion for releasably interconnecting said back-up tong apparatus with said rotary tong assembly.

7. Apparatus as defined in claim 6, wherein each of said shear means is selectively positionable on said leg members for maintaining a preferred spacing between said rotary tong assembly and said back-up apparatus.

8. Apparatus as defined in claim 7, further comprising resilient means positioned between said shear means and said back-up tong apparatus.

9. The apparatus of claim 6, further comprising biasing means connected with each of said leg portions of said rotary tong assembly for biasing said apparatus for securing a pipe member toward said rotary tong assembly.

10. Apparatus for rotating a first pipe member and for preventing axial rotation of a second pipe member, comprising:

the rotary tong assembly for rotating said first pipe member, a plurality of downward extending leg members affixed to said rotary tong assembly, a back-up tong apparatus for preventing axial rotation of said second pipe member, said back-up tong apparatus including first and second gripping members radially and oppositely moveable toward said second pipe member, first and second lever means pivotally and oppositely movable for engagement with respective ones of said gripping members and in functional relationship to movement of said gripping members toward said second pipe member, and first and second hydraulic cylinder means each having piston members interconnected with respective ones of said first and second lever means, said back-up tong apparatus including an upper plate member adjacent said first and second lever means for supporting said gripping members and having a plurality of apertures for receiving said downward extending leg members, and a plurality of shear means each affixed to a respective leg member for releasably interconnecting said back-up tong apparatus with said rotary tong assembly.

11. Apparatus as defined in claim 10, wherein each of said shear means is selectively positionable on said leg member for maintaining a preferred spacing between said rotary tong assembly and said back-up apparatus.

12. Apparatus as defined in claim 11, further comprising resilient means positioned between said shear means and said back-up tong apparatus.

13. The apparatus described in claim 10, further comprising a pair of spaced-apart guide members each slidably engaging a respective one of said gripping members and defining an open throat aperture for receiving and accommodating said pipe member between said gripping members.

14. The apparatus described in claim 10, further including a hydraulic control system for actuating said hydraulic cylinders, comprising:

a source of hydraulic fluid under a pressure, pressure line means coupled to said source to receive said fluid under said pressure, return line means coupled to said source to deliver said fluid under said pressure, flow divider means interconnected between said pressure line means and said hydraulic cylinders, and a pair of check valve means each interconnected between said flow divider means and a respective one of said hydraulic cylinder means.

* * * * *